US011859839B2

(12) United States Patent
Chiu

(10) Patent No.: US 11,859,839 B2
(45) Date of Patent: Jan. 2, 2024

(54) PORTABLE AIR CONDITIONER AND OPERATION MODE SWITCHING METHOD THEREOF

(71) Applicant: NEW WIDETECH INDUSTRIES CO., LTD., New Taipei (TW)

(72) Inventor: Ming-Tsung Chiu, New Taipei (TW)

(73) Assignee: New Widetech Industries Co., Ltd., New Taipei (TW)

( * ) Notice: Subject to any disclaimer, the term of this patent is extended or adjusted under 35 U.S.C. 154(b) by 140 days.

(21) Appl. No.: 17/646,340

(22) Filed: Dec. 29, 2021

(65) Prior Publication Data

US 2023/0204237 A1 Jun. 29, 2023

(51) Int. Cl.

| | |
|---|---|
| ***F24F 11/30*** | (2018.01) |
| ***F24F 1/022*** | (2019.01) |
| ***F24F 1/0358*** | (2019.01) |
| ***F24F 11/74*** | (2018.01) |
| ***F24F 11/89*** | (2018.01) |

(52) U.S. Cl.

CPC ..... *F24F 11/30* (2018.01); *F24F 1/022* (2013.01); *F24F 1/0358* (2019.02); *F24F 11/74* (2018.01); *F24F 11/89* (2018.01)

(58) Field of Classification Search

CPC .... F24F 1/04; F24F 2221/12; F24F 2221/125; F24F 1/0358

See application file for complete search history.

(56) References Cited

U.S. PATENT DOCUMENTS

| | | | | |
|---|---|---|---|---|
| 11,787,258 | B2 * | 10/2023 | Makimoto | B60H 1/3227 62/238.3 |
| 2014/0150488 | A1 * | 6/2014 | Black | F24F 3/14 29/890.035 |
| 2020/0011550 | A1 * | 1/2020 | Williams | F24F 1/022 |
| 2023/0204237 | A1 * | 6/2023 | Chiu | F24F 11/89 62/133 |

FOREIGN PATENT DOCUMENTS

| | | | |
|---|---|---|---|
| CN | 113606664 | A | 11/2021 |
| TW | I322877 | B | 4/2010 |
| TW | M504931 | U | 7/2015 |
| TW | M511032 | U | 10/2015 |
| TW | M627662 | U | 6/2022 |

* cited by examiner

*Primary Examiner* — Henry T Crenshaw

(74) *Attorney, Agent, or Firm* — Rosenberg, Klein & Lee

(57) ABSTRACT

A portable air conditioner has a housing assembly and an operating unit including a refrigerant circulating system and an air guiding system both mounted in the housing assembly. The air guiding system has an air channel switching device and has an evaporating end fan and a condensing end fan both mounted in the air channel switching device. An operation mode switching method of the portable air conditioner has a cooling mode and a dehumidifying mode. In the dehumidifying mode, cool air drawn by the evaporating end fan flows through a condenser and is heated to become hot air and is discharged. Therefore, the portable air conditioner has both cooling function like an ordinary air conditioner and dehumidifying function like an ordinary dehumidifier.

20 Claims, 15 Drawing Sheets

PORTABLE AIR CONDITIONER AND OPERATION MODE SWITCHING METHOD THEREOF

BACKGROUND OF THE INVENTION

1. Field of the Invention

The present invention relates to an air conditioner, especially to a portable air conditioner having both cooling and dehumidifying functions and an operation mode switching method of the portable air conditioner.

2. Description of the Prior Art(s)

A conventional air conditioner, especially an air conditioner for cooling, is mainly used to control the temperature and may be additionally used to dehumidify air. The working principle of a dehumidifying mode of the conventional air conditioner is to draw in indoor air with a fan. When the air passes through low temperature refrigerant piping in an evaporator of the conventional air conditioner, moisture contained in the air is condensed into water droplets. The water droplets are then accumulated and then discharged. The air passing through high temperature refrigerant piping in a condenser of the conventional air conditioner dissipates heat from the condenser to the outdoors. Thus, temperature and humidity indoors are both lowered.

Although the conventional air conditioner for cooling can also dehumidify the air, the dehumidifying function is actually an additional effect of cooling the air. Therefore, in order to dehumidify the air, it is necessary to set a target temperature of the conventional air conditioner to be 4° C. or above lower than the current room temperature, such that the dehumidification effect can be obvious. However, when the pre-set target differs greatly from the room temperature, the conventional air conditioner would consume more power. Moreover, when using the conventional air conditioner to dehumidify in the colder autumn or winter, the temperature indoors will be too low and cause discomfort. Therefore, to keep indoor environment comfortable, it is best for a user to prepare at least one additional dehumidifier, such that the user can dehumidify the indoor air with the conventional air conditioner in summer and with the at least one dehumidifier in winter, which is a financial burden to the user. In addition, a lot of indoor spaces would be occupied.

To overcome the shortcomings, the present invention provides a portable air conditioner and an operation mode switching method of the air conditioner to mitigate or obviate the aforementioned problems.

SUMMARY OF THE INVENTION

The main objective of the present invention is to provide a portable air conditioner and an operation mode switching method of the portable air conditioner.

The portable air conditioner has a housing assembly and an operating unit. The housing assembly has an interior space, an evaporating end inlet, the cool air outlet, the condensing end inlet, and a hot air outlet. The interior space is defined in the housing assembly. The evaporating end inlet, the cool air outlet, the condensing end inlet and the hot air outlet are formed through the housing assembly and communicates with the interior space.

The operating unit includes a refrigerant circulating system and an air guiding system. The refrigerant circulating system is mounted in the interior space of the housing assembly and includes an evaporator, a condenser, a compressor and an expansion device that are connected with each other. The evaporator is disposed beside the evaporating end inlet and the condenser is disposed beside the condensing end inlet. The air guiding system is mounted in the interior space of the housing assembly and has an air channel switching device, an evaporating end fan, and a condensing end fan. The evaporating end fan is mounted in the air channel switching device, and is disposed adjacent to the evaporator, the evaporating end inlet and the cool air outlet. The condensing end fan is mounted in the air channel switching device, and is disposed adjacent to the condenser, the condensing end inlet and the hot air outlet. A channel is formed between the evaporating end fan and the condensing end fan and the air channel switching device selectively opens or closes the channel.

The operation mode switching method has a cooling mode and a dehumidifying mode. In the cooling mode, the air channel switching device closes the channel between the evaporating end fan and the condensing end fan. In the dehumidifying mode, the air channel switching device opens the channel between the evaporating end fan and the condensing end fan.

The portable air conditioner of the present invention can be switched between the cooling mode and the dehumidifying mode. In the dehumidifying mode, cool air drawn by the evaporating end fan directly flows through the condenser and is heated to become hot air and is discharged from the hot air outlet. Therefore, the portable air conditioner of the present invention has both cooling function like an ordinary air conditioner and dehumidifying function like an ordinary dehumidifier. When the portable air conditioner of the present invention works under the dehumidifying mode, warm air would be discharged. Accordingly, when the portable air conditioner is used in cold weather, the room temperature would not become too low to cause discomfort.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
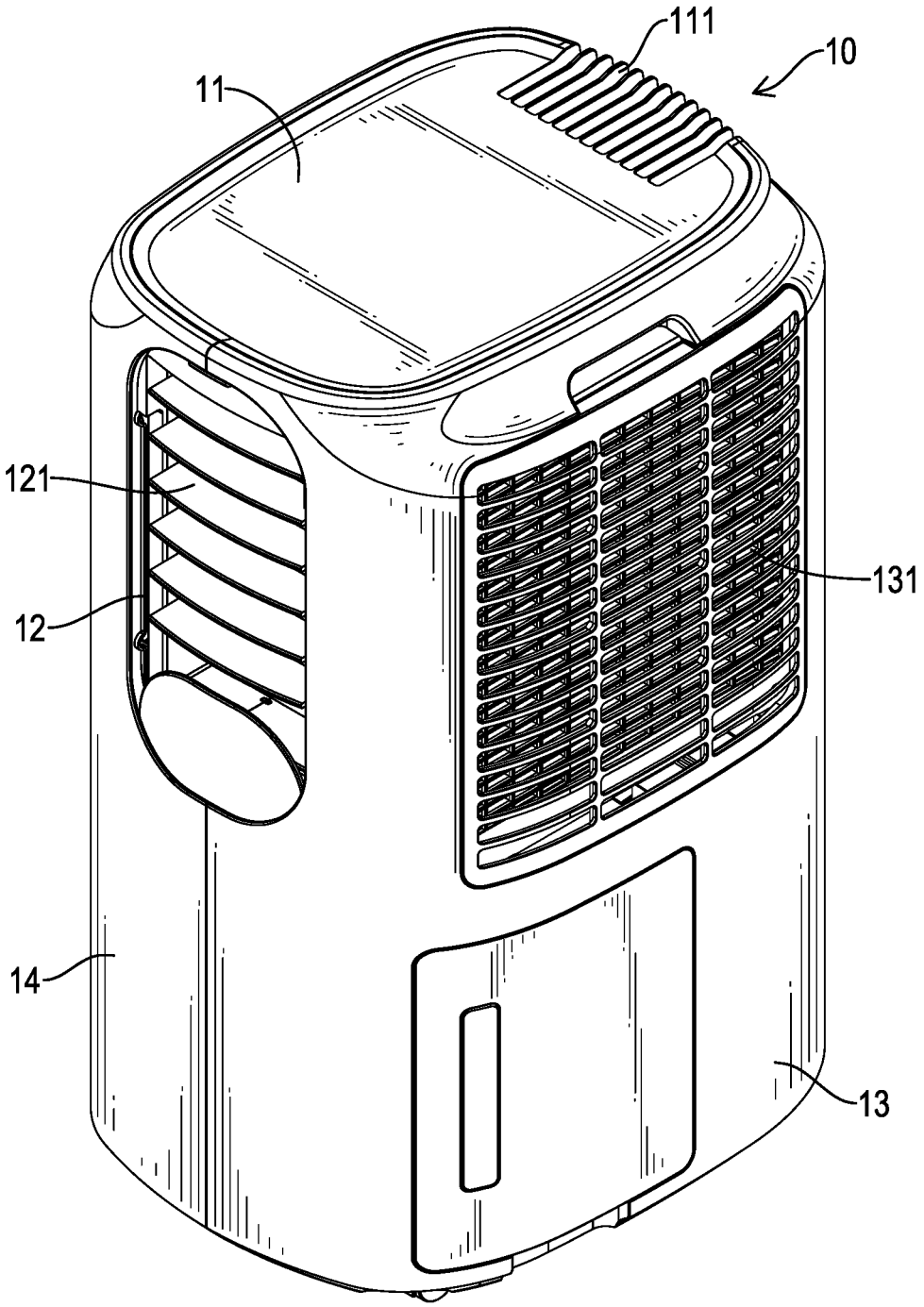
FIG. 1 is a perspective view of a first embodiment of a portable air conditioner in accordance with the present invention.
Figure 2:
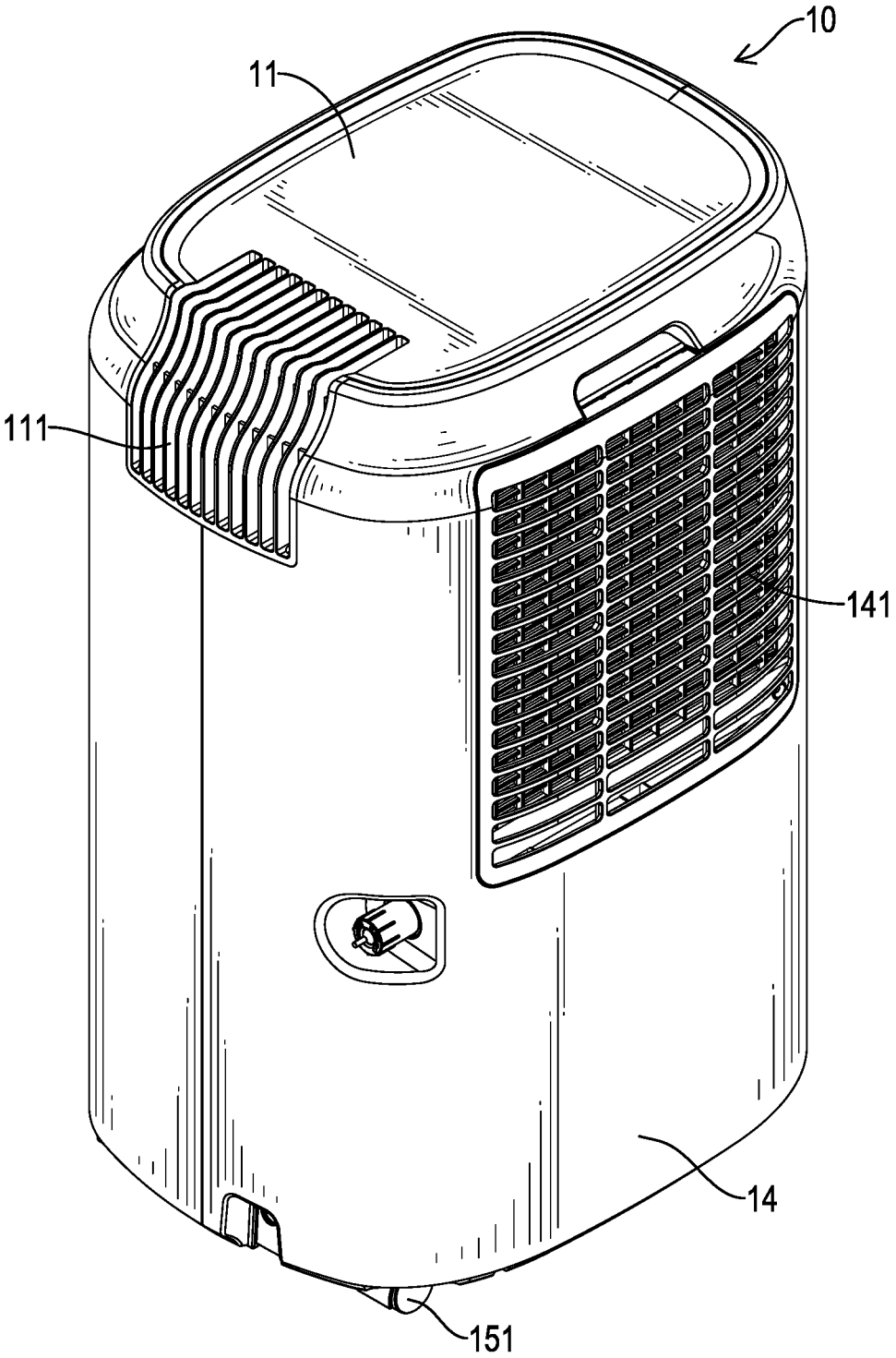
FIG. 2 is another perspective view of the portable air conditioner in FIG. 1.
Figure 3:
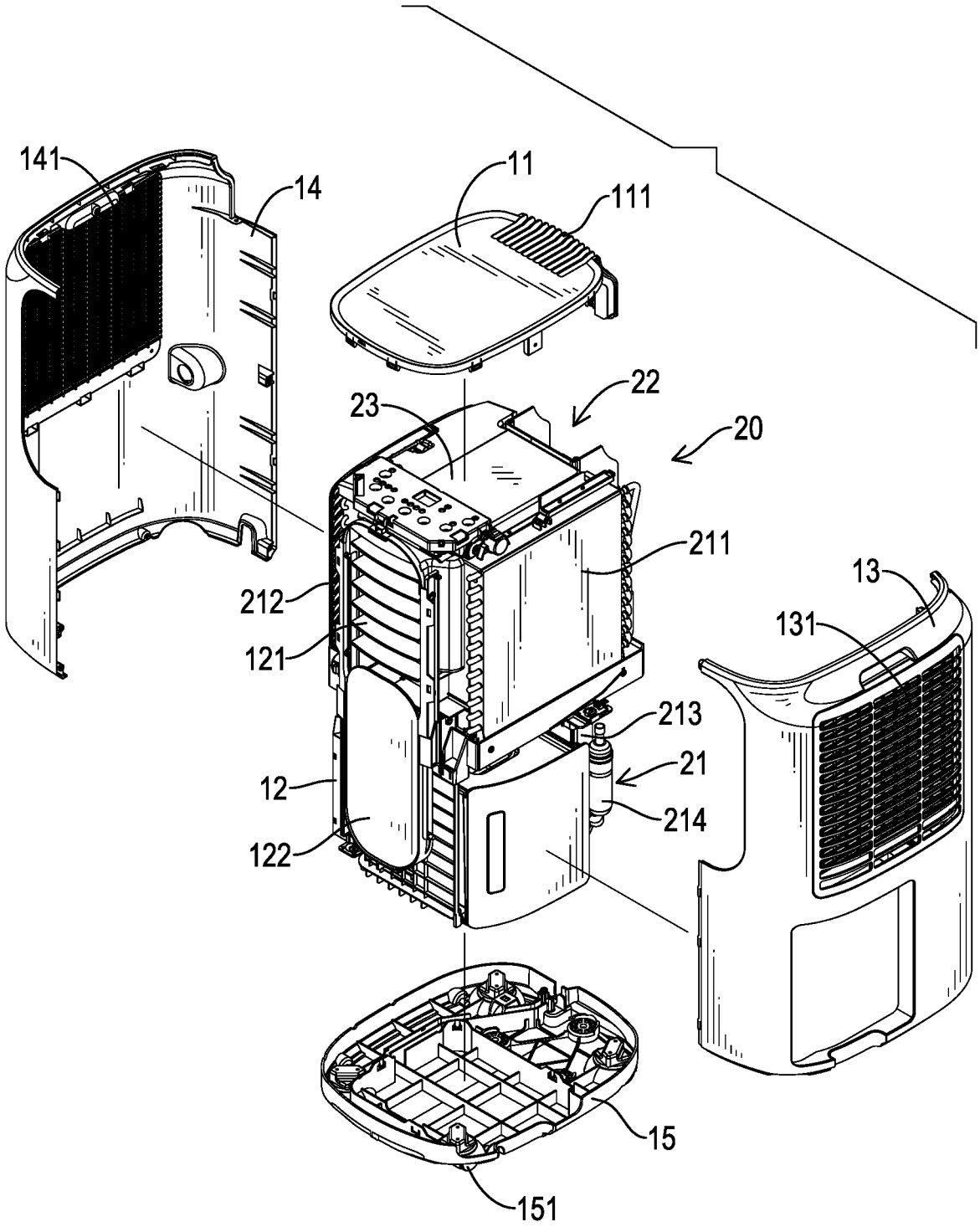
FIG. 3 is an exploded perspective of the portable air conditioner in FIG. 1.

With reference to FIGS. 1 to 3, a first preferred embodiment of a portable air conditioner in accordance with the present invention comprises a housing assembly 10 and an operating unit 20.

The housing assembly 10 includes a top cover 11, a front cover 12, an evaporating end cover 13, a condensing end cover 14, and a bottom cover 15. The top cover 11 has a hot air outlet 111 formed through the top cover 11. The front cover 12 has a cool air outlet 121 formed through the front cover 12. A shielding panel 122 is mounted on the front cover 12 and is disposed by the cool air outlet 121. The cool air outlet 121 is selectively opened or covered by the shielding panel 122. Specifically, the shielding panel 122 slides up and down to selectively open or closes the cool air outlet 121. A structure allowing the shielding panel 122 to slide up and down is conventional and thus further details about the structure is omitted.

The evaporating end cover 13 has an evaporating end inlet 131 formed through the evaporating end cover 13. The condensing end cover 14 has a condensing end inlet 141 formed through the condensing end cover 14. The bottom cover 15 has multiple wheels 151 mounted on a bottom of the bottom cover 15.

An interior space is surrounded by the top cover 11, the front cover 12, the evaporating end cover 13, the condensing end cover 14, and the bottom cover 15. The evaporating end inlet 131, the condensing end inlet 141, the hot air outlet 111, and the cool air outlet 121 communicate with the interior space. In the first preferred embodiment, each of the evaporating end inlet 131, the condensing end inlet 141, the hot air outlet 111 and the cool air outlet 121 is, but not limited to be, formed as a grille.

Figure 4:
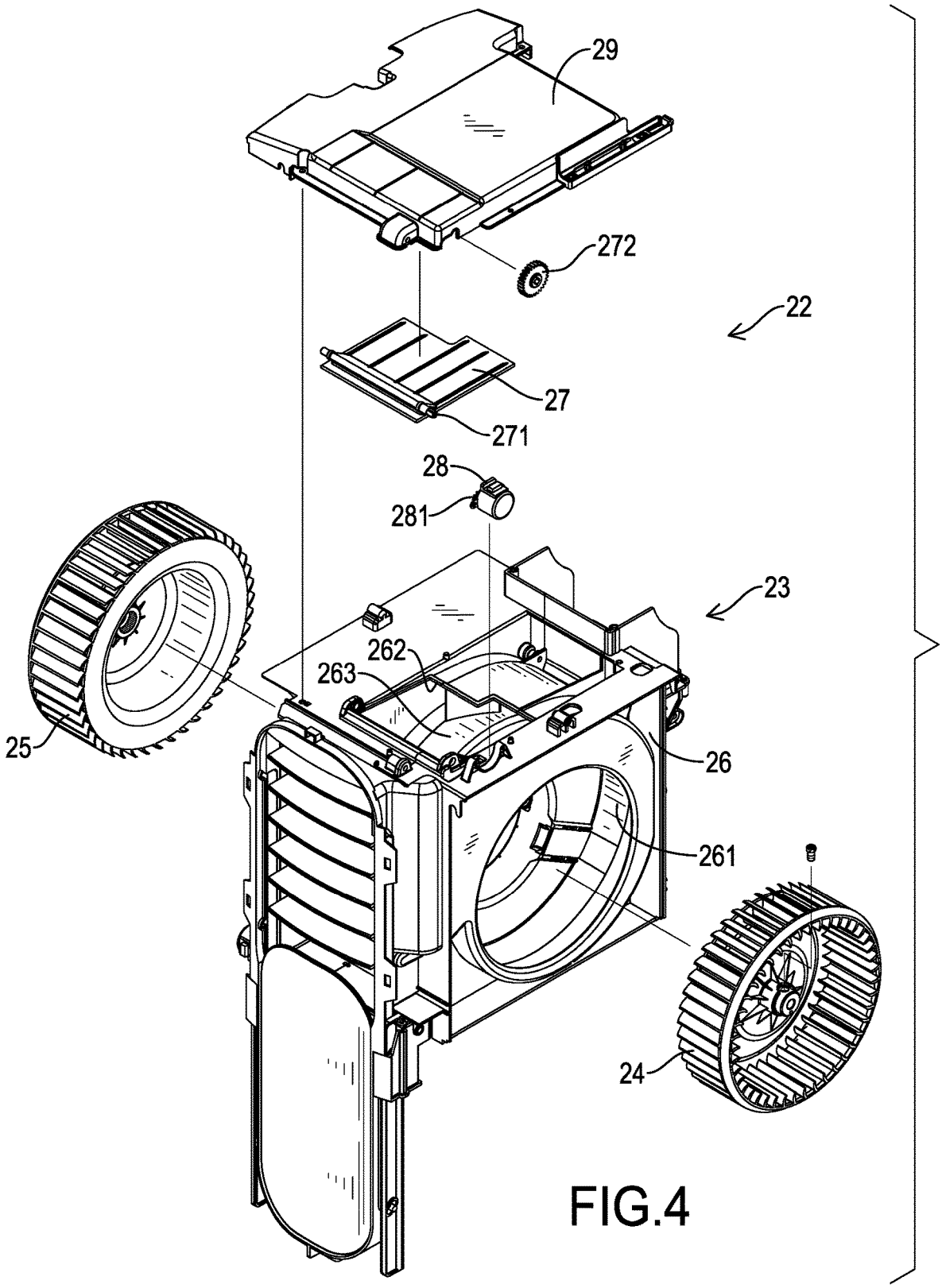
FIG. 4 is an exploded perspective view of an air guiding system of the portable air conditioner in FIG. 1.

With reference to FIGS. 3 and 4, the operating unit 20 includes a refrigerant circulating system 21 and an air guiding system 22. The refrigerant circulating system 21 is mounted in the interior space of the housing assembly 10 and includes an evaporator 211, a condenser 212, a compressor 213, and an expansion device 214 that are connected with each other. Specifically, the evaporator 211 and the condenser 212 are oppositely disposed, and the compressor 213 and the expansion device 214 are disposed at a bottom of the refrigerant circulating system 21. The refrigerant circulating system 21 is a conventional standard component and thus further details about the refrigerant circulating system is omitted.

With further reference to FIGS. 3 to 5 and 8, the air guiding system 22 is mounted in the interior space of the housing assembly 10 and has an air channel switching device 23, an evaporating end fan 24, and a condensing end fan 25.

The air channel switching device 23 includes a guiding housing 26, a switching valve 27, a driving device 28, and a guiding cover 29. The guiding housing 26 is mounted in the interior space of the housing assembly 10 and has an evaporating end recess 261, a valve port 262, a connecting channel 263, a condensing end recess 264, and a hot air channel 265. The evaporating end recess 261 is formed in one of two sides of the guiding housing 26. The valve port 262 is formed through an upper side of the guiding housing 26 and communicates with the evaporating end recess 261. The connecting channel 263 is a three-way channel and communicates with the evaporating end recess 261, the cool air outlet 121, and the valve port 262. The condensing end recess is formed in the other one of the two sides of the guiding housing 26. The hot air channel 265 has two ends communicating with the condensing end recess 264 and the hot air outlet 111 respectively.

With reference to FIGS. 4 to 7, the switching valve 27 is a plate, is mounted on the guiding housing 26, is pivotally connected to the guiding housing 26, and is disposed adjacent to the valve port 262. Specifically, the switching valve 27 has a pivot pin 271 and a driven gear 272. The pivot pin 271 is disposed on an end edge of the switching valve 27 and is pivotally connected to the guiding housing 26 beside the valve port 262. The driven gear is disposed on an end of the pivot pin 271.

The driving device 28 is a motor, is mounted on the guiding housing 26, is connected to the switching valve 27, and has a driving gear 281 meshing with the driven gear 272. Thus, when the driving device 28 drives the driven gear 272 to rotate through the driving gear 281, the switching valve 27 selectively opens or closes the valve port 262. However, the switching valve 27 is not limited to the above-mentioned form, and can be modified as needed.

The guiding cover 29 is mounted on the guiding housing 26, covers a top of the guiding housing 26, and has a guiding recess 291 formed in an end edge of the guiding cover 29. An upper channel 292 is formed between the guiding cover 29 and the guiding housing 26 and connects a first mounting space, in which the evaporator end fan 24 is mounted, and a second mounted space, in which the condensing end fan 25 is mounted. Specifically, the upper channel 292 is formed in the guiding recess 291 and connects the valve port 262 and the condensing end recess 264.

Figure 5:
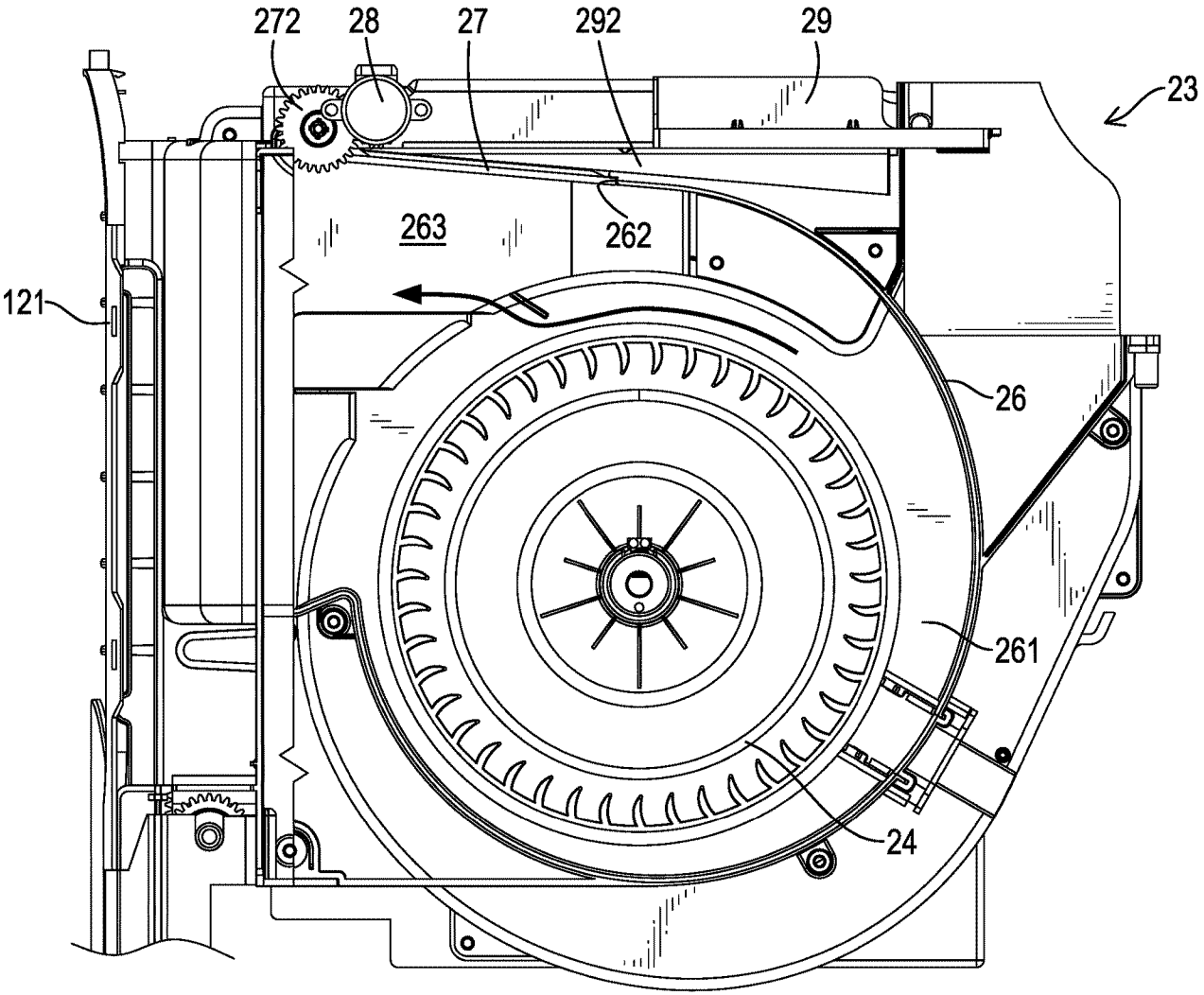
FIG. 5 is an enlarged cross-sectional side view of an evaporating end of the portable air conditioner in FIG. 1, shown operating in a cooling mode.
Figure 6:
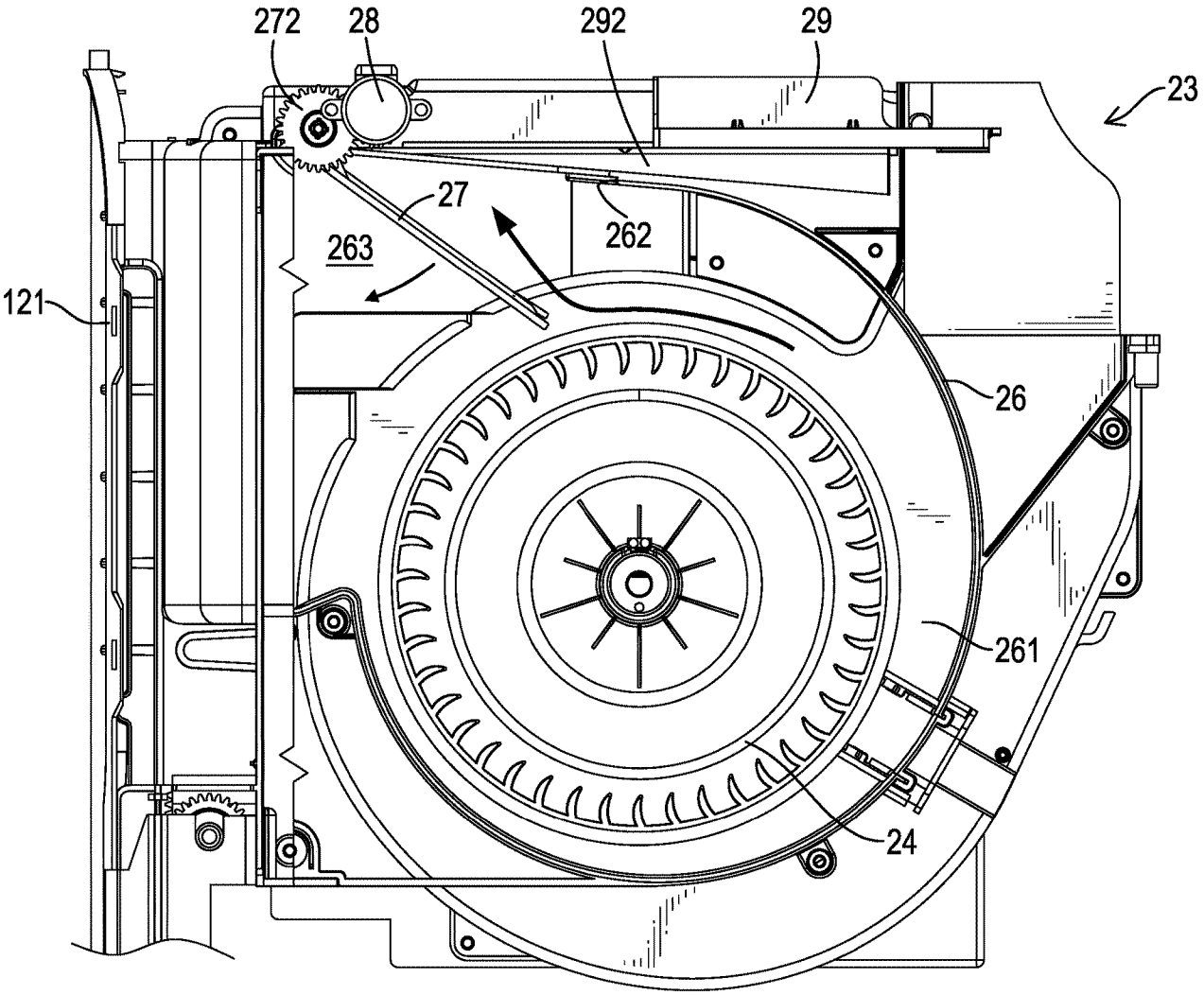
FIG. 6 is an enlarged cross-sectional side view of the evaporating end of the portable air conditioner in FIG. 1, shown operating in a dehumidifying mode.
Figure 7:
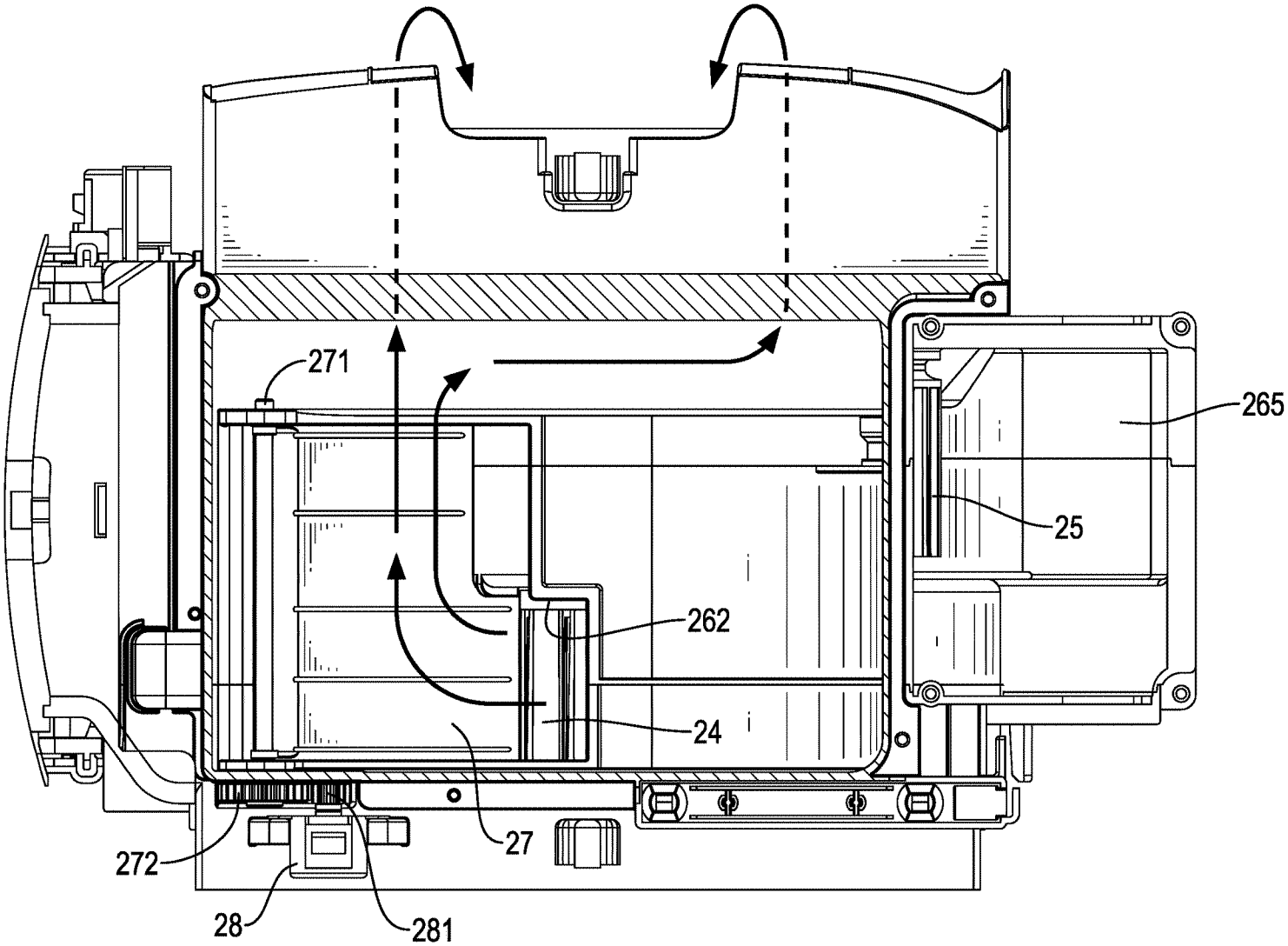
FIG. 7 is a top cross-sectional view of the portable air conditioner in FIG. 1, shown operating in the dehumidifying mode.
Figure 8:
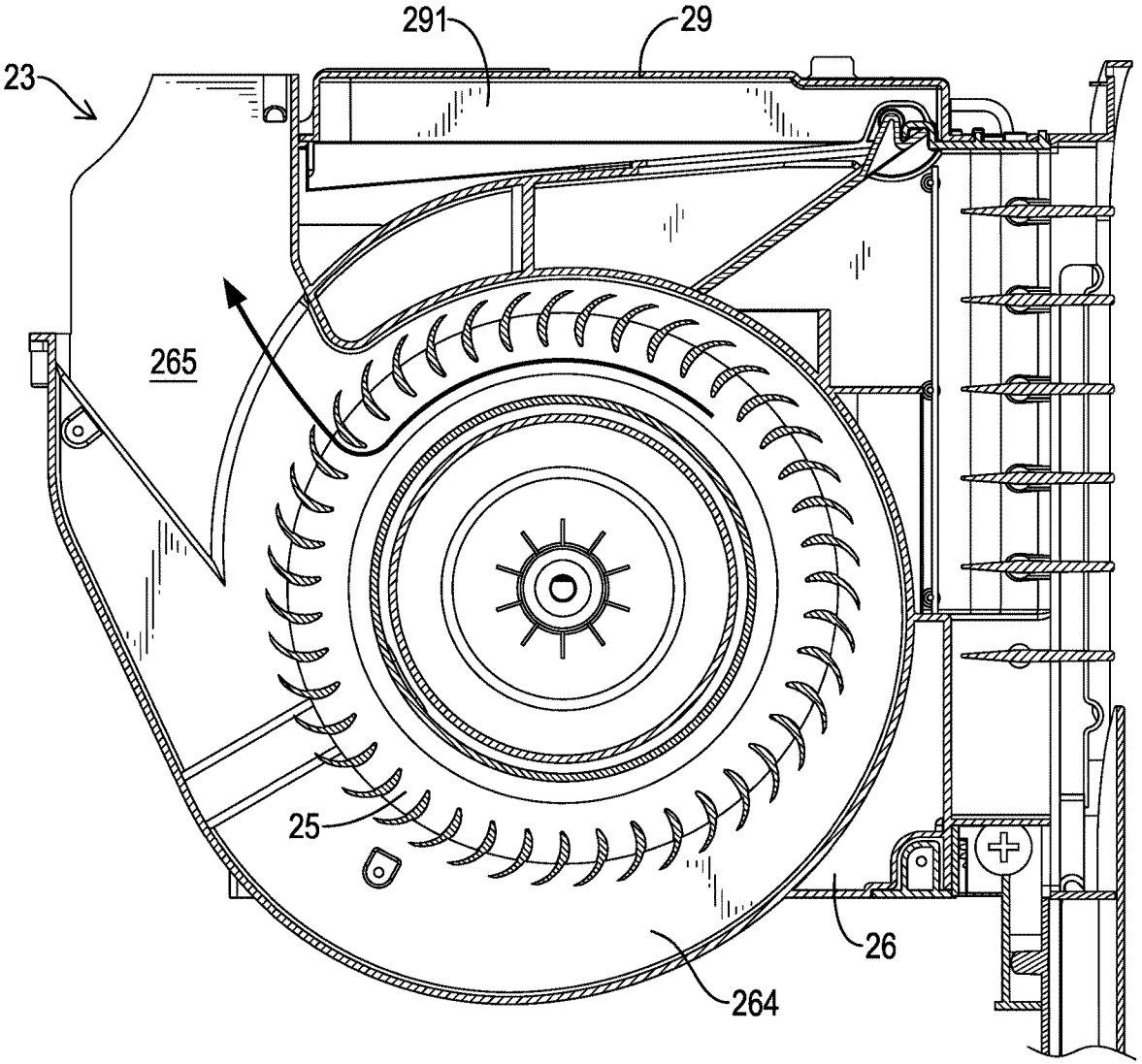
FIG. 8 is an enlarged cross-sectional side view of a condensing end of the portable air conditioner in FIG. 1, shown operating in the cooling mode.
Figure 9:
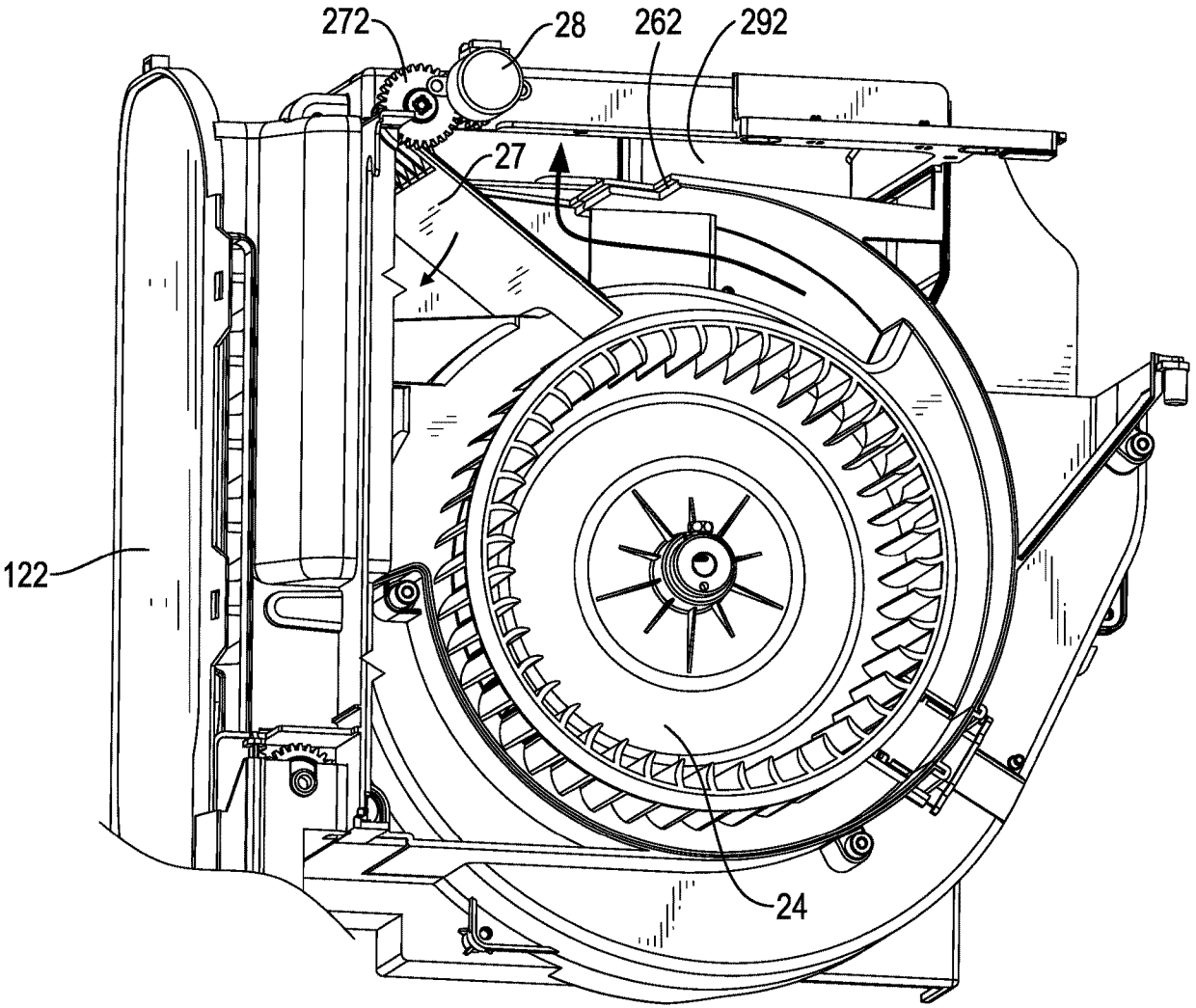
FIG. 9 is an enlarged perspective view of the portable air conditioner in FIG. 1, showing airflow in the evaporating end.
Figure 10:
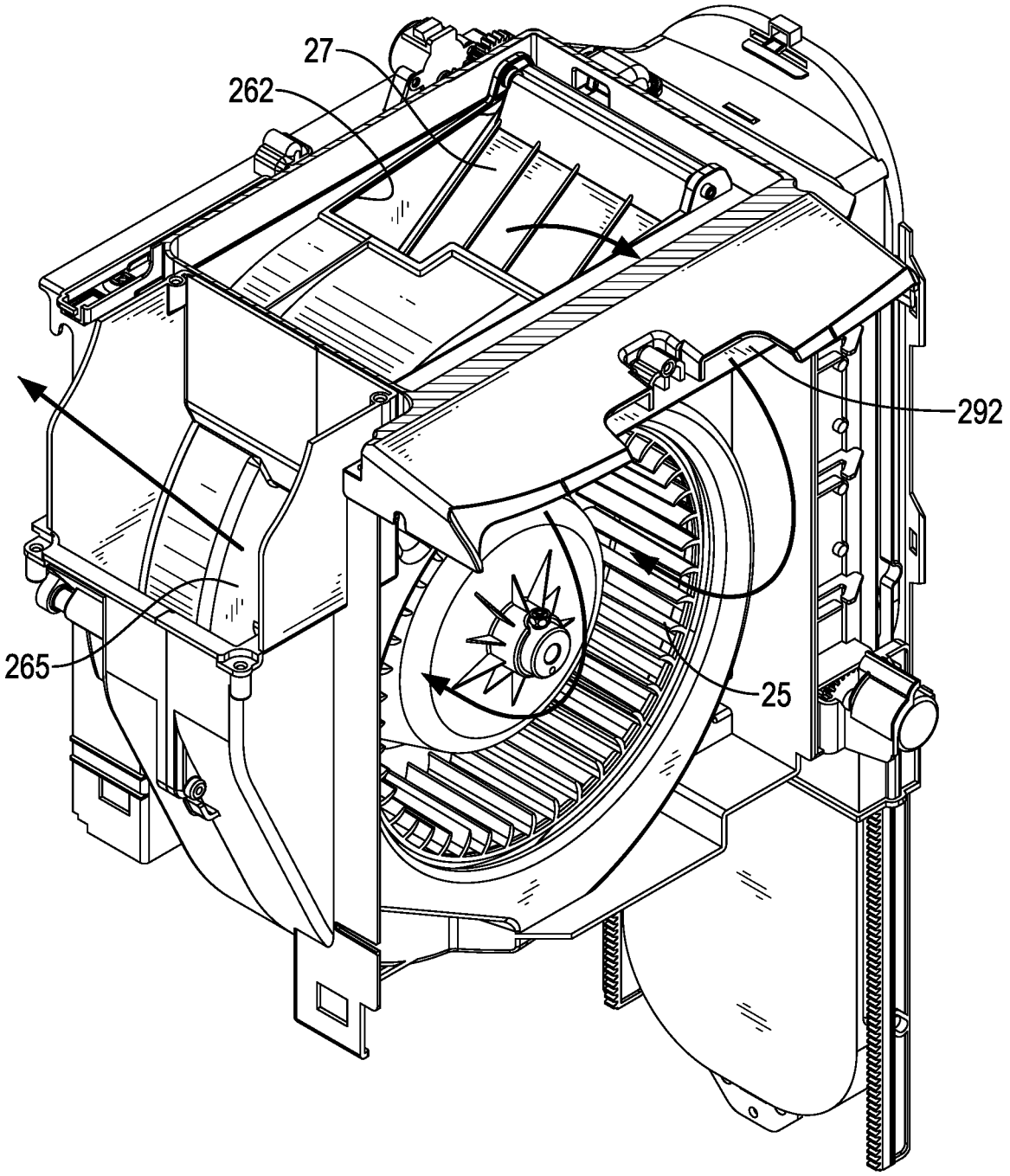
FIG. 10 an enlarged perspective view of the portable air conditioner in FIG. 1, showing the airflow in the condensing end.

With reference to FIGS. 4, 5, and 8, the evaporating end fan 24 is mounted in the air channel switching device 23 and is mounted in the evaporating end recess 261 of the guiding housing 26. The evaporator 211 is disposed by an outer side of the evaporating end recess 261, and the evaporating end inlet 131 of the evaporating end cover 13 is disposed beside the evaporator 211. Moreover, the condensing end fan 25 is mounted in the air channel switching device 23 and is mounted in the condensing end recess 264 of the guiding housing 26. The condenser 212 is disposed by an outer side of the condensing end recess 264, and the condensing end inlet 141 of the condensing end cover 14 is disposed beside the condenser 212.

The air channel switching device 23 is disposed between the evaporating end fan 24 and the condensing end fan 25.

A channel is formed between the evaporating end recess 261 and the condensing end recess 264 and is formed by connecting the connecting channel 263 and the upper channel 292.

The portable air conditioner of the present invention can be switched between a cooling mode and a dehumidifying mode.

With reference to FIGS. 5 and 8, in the cooling mode, the switching valve 27 is switched to close the valve port 262, such that the upper channel 292 is closed. The shielding panel 122 is switched to open the cool air outlet 121. The evaporating end fan 24 draws in a first exterior air and the first exterior air flows through the evaporating end inlet 131 and the evaporator 211 to become cool air and then is discharged from the cool air outlet 121. Meanwhile, the condensing end fan 25 draws in a second exterior air and the second exterior air flows through the condensing end inlet 141 and the condenser 212 to become hot air and then is discharged from the hot air outlet 111. The first exterior air and the second exterior air flow along separate flowing paths that are not connected with each other. A guiding pipe may be connected to the hot air outlet 111 to exhaust the hot air to the outdoors.

With reference to FIGS. 6, 7, 9, and 10, in the dehumidifying mode, in the dehumidifying mode, the switching valve 27 is switched to open the valve port 262, such that the upper channel 292 communicates with the evaporating end recess 261, in which the evaporating end fan 24 is mounted. The shielding panel 122 is switched to close the cool air outlet 121. The evaporating end fan 24 draws in a third exterior air and the third exterior air flows through the evaporating end inlet 131, the evaporator 211, the valve port 262, the upper channel 292 and the condenser 212 to become hot air and is discharged from the hot air outlet 111.

In the foregoing process, the cool third exterior air drawn by the evaporating end fan 24 in the dehumidifying mode directly flows through the condenser 212 and is heated to become said hot air and is discharged from the hot air outlet 111. Therefore, compared with a dehumidifying function of a conventional conditioner which can only work below room temperature, the portable air conditioner of the present invention has both cooling function like an ordinary air conditioner and dehumidifying function like an ordinary dehumidifier. When the portable air conditioner of the present invention works under the dehumidifying mode, warm air would be discharged. Accordingly, when the portable air conditioner is used in cold weather, the room temperature would not become too low to cause discomfort.

Figure 11:
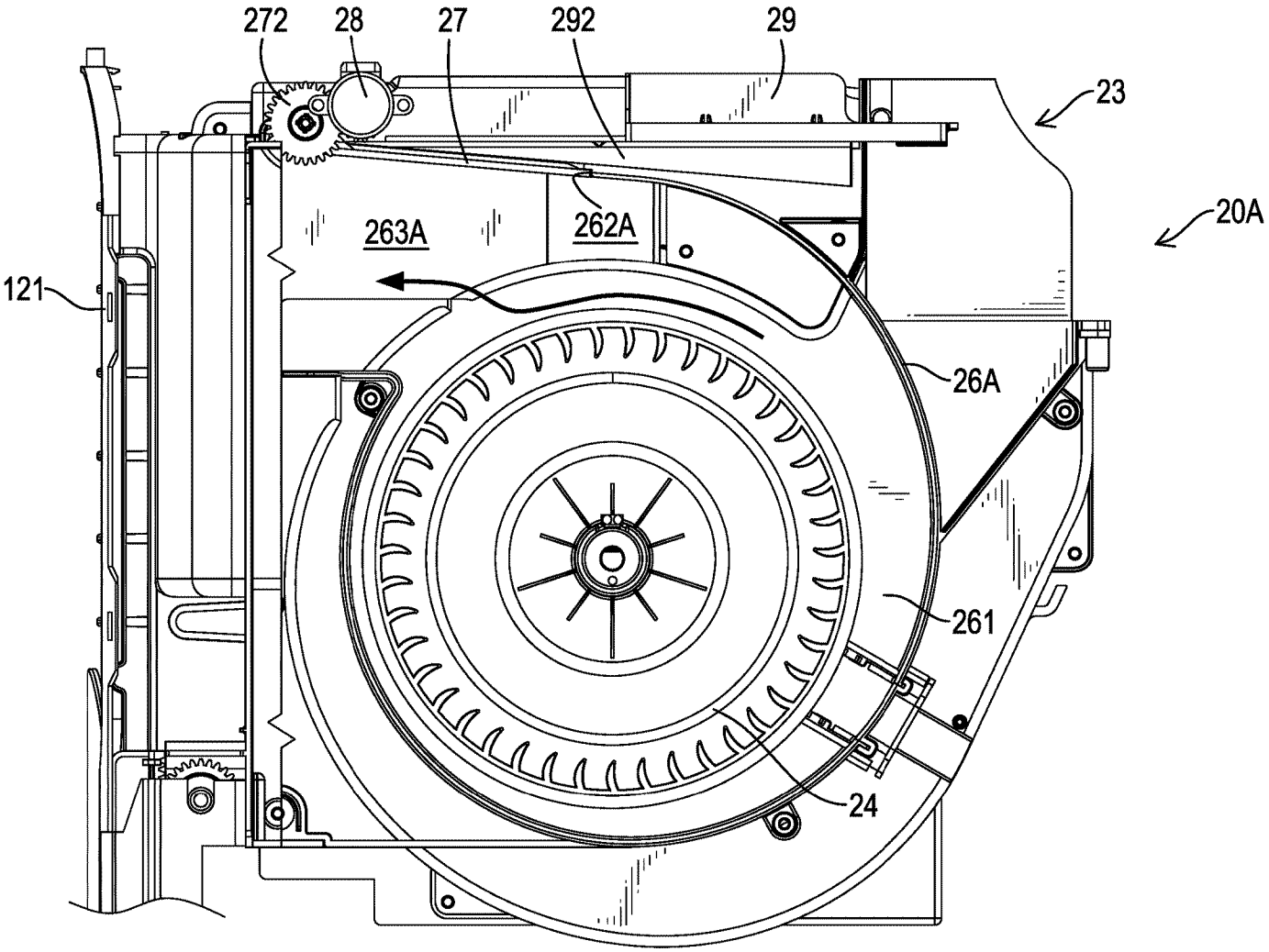
FIG. 11 is an enlarged cross-sectional side view of an evaporating end of a second embodiment of a portable air conditioner in accordance with the present invention, shown operating in a cooling mode.

With reference to FIG. 11, a second preferred embodiment of a portable air conditioner in accordance with the present invention is shown. The second embodiment of the portable air conditioner has the same housing assembly 10 as the first embodiment of the portable air conditioner. The difference between the second and first embodiments of the portable air conditioner is that, in the second embodiment of the portable air conditioner, an opening, which is disposed adjacent to the connecting channel 263A, of the guiding housing 26A of the operating unit 20A is reduced.

Figure 12:
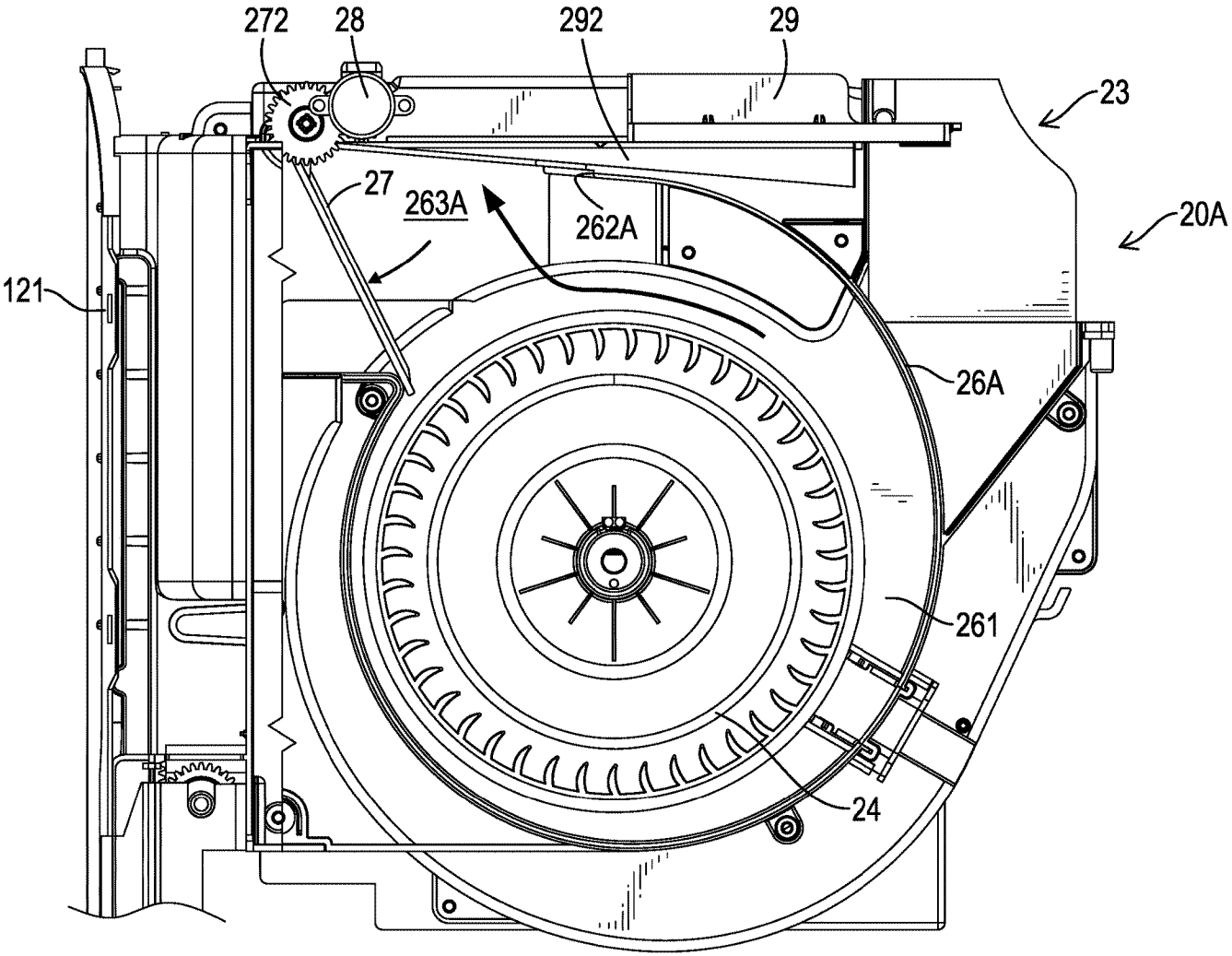
FIG. 12 is an enlarged cross-sectional side view of the evaporating end of the portable air conditioner in FIG. 11, shown operating in a dehumidifying mode.

In other words, when operating under the cooling mode, the switching valve 27 is switched to fully close the valve port 262A, which is the same like the first embodiment of the portable air conditioner. With reference to FIG. 12, when operating under the dehumidifying mode, the switching valve 27 can fully close the cool air outlet 121. Accordingly, airflow inside the second embodiment of the portable air conditioner can be more completely delivered to the upper channel 292 than the first embodiment of the portable air conditioner, so as to reduce loss of volume of the airflow.

Figure 13:
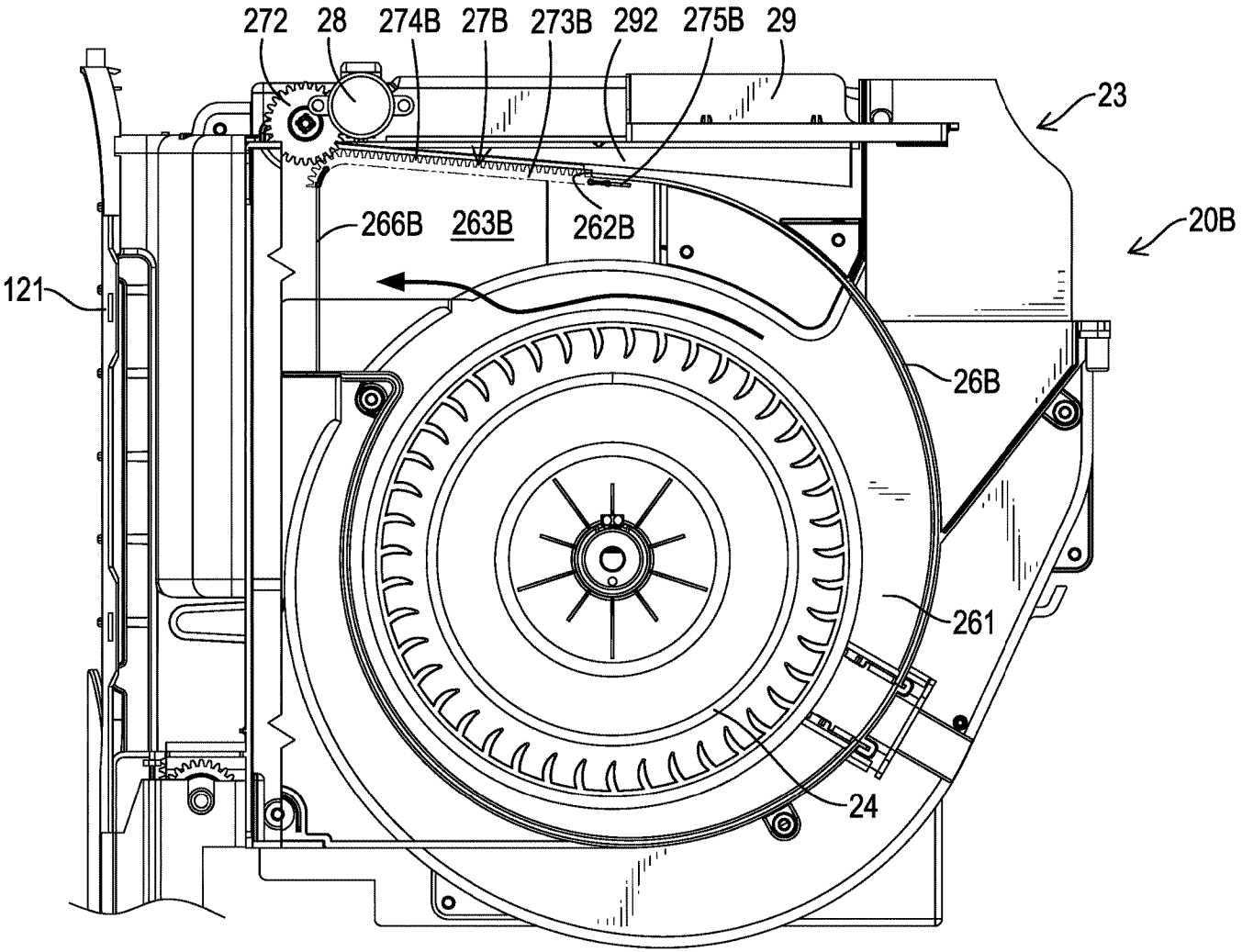
FIG. 13 is an enlarged cross-sectional side view of an evaporating end of a third embodiment of a portable air conditioner in accordance with the present invention, shown operating in a cooling mode.
Figure 15:
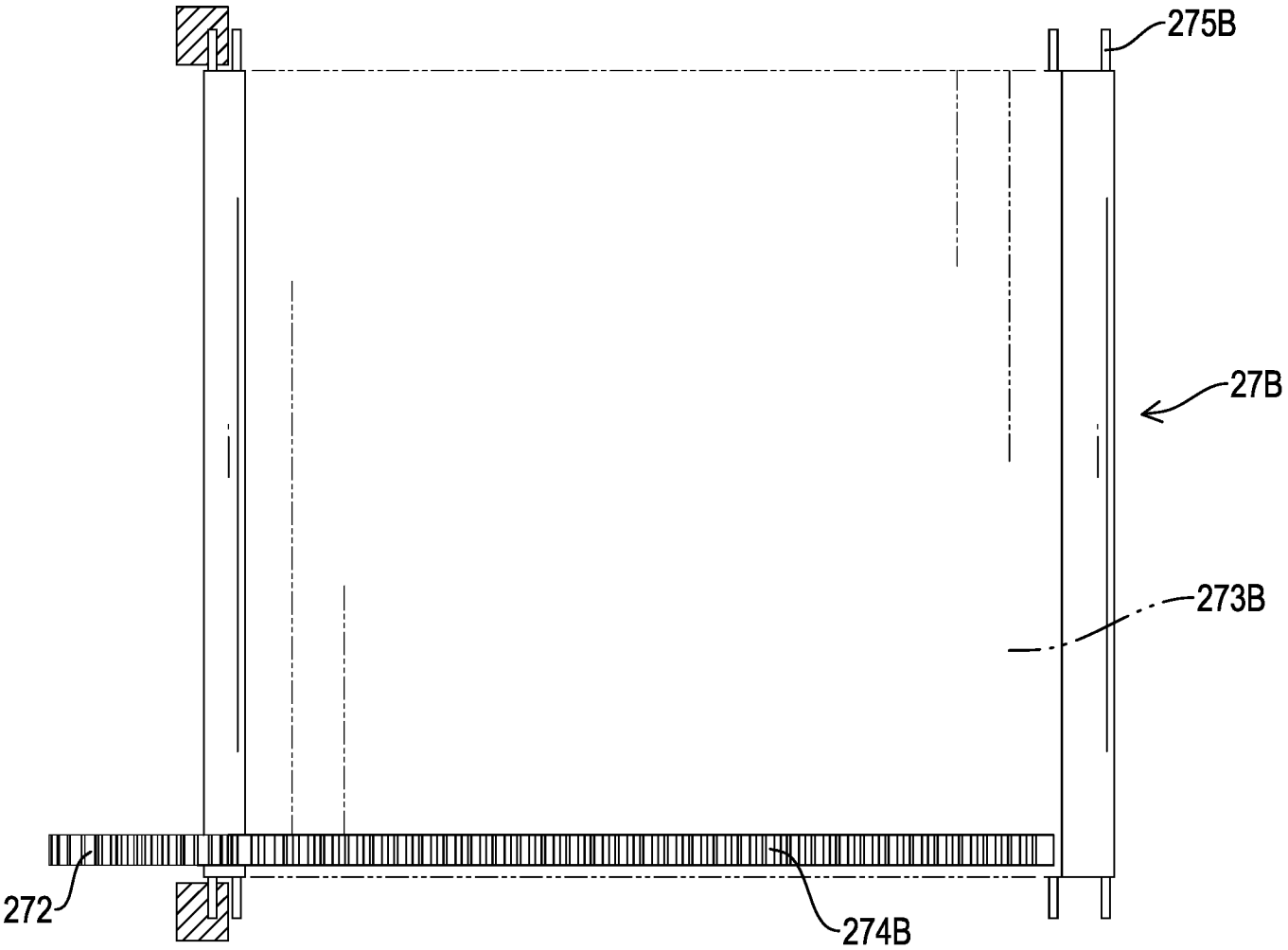
FIG. 15 is an enlarged top view of a switching valve of the portable air conditioner in FIG. 13.

With reference to FIGS. 13 and 15, a third preferred embodiment of a portable air conditioner in accordance with the present invention is shown. The third embodiment of the portable air conditioner has the same housing assembly 10 as the first embodiment of the portable air conditioner. The difference between the third and first embodiments of the portable air conditioner is that two guiding rails 266B are mounted on an end, which is disposed adjacent to the connecting channel 263B, of the guiding housing 26B of the operating unit 20B. Each one of the guiding rails 266B is disposed opposite to the other guiding rail 266B, is bent, and extends from the valve port 262B toward the cool air outlet 121.

The switching valve 27B is a soft plate and has a main body 273B, a guiding portion 274B, and multiple guiding elements 275B. The guiding portion 274B is formed on a side edge of a top surface of the main body 273B. In the third preferred embodiment, the guiding portion 274B is, but not limited to, a rack. The guiding elements 275B are mounted on an outer peripheral edge of the main body 273B. Each of the guiding elements 275B is mounted on a corresponding one of the guiding rails 266B and is slidable relative to the corresponding one of the guiding rails 266B. The guiding portion 274B is connected with the driving device 28. Specifically, the guiding portion 274B meshes with the driven gear 272.

Figure 14:
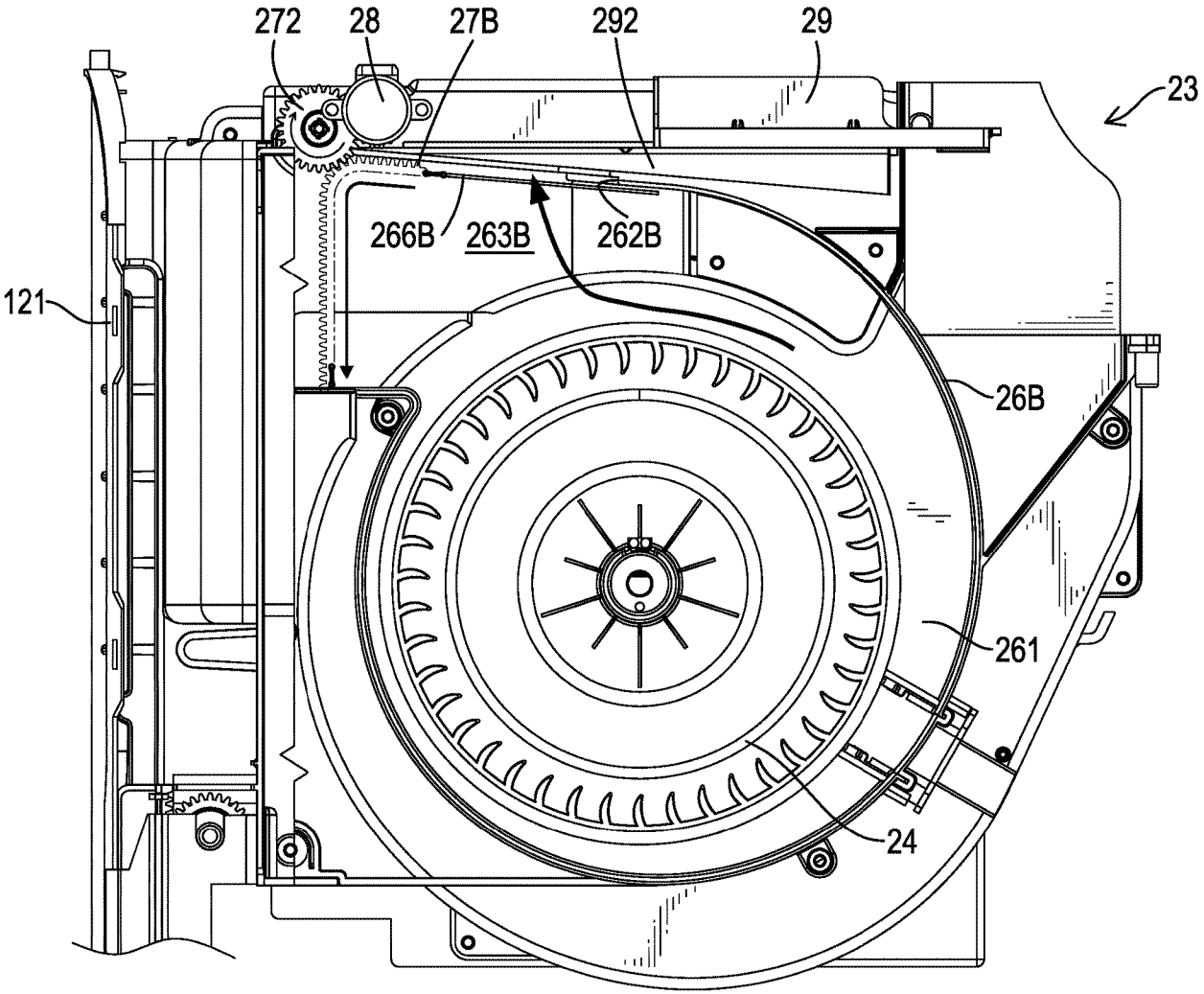
FIG. 14 is an enlarged cross-sectional side view of the evaporating end of the portable air conditioner in FIG. 13, shown operating in a dehumidifying mode.

When operating under the cooling mode, the switching valve 27B, the switching valve 27B fully closes the valve port 262B. With reference to FIG. 14, when operating under the dehumidifying mode, the switching valve 27B is moved toward the cool air outlet 121 by the driven gear 272, so as to fully close the cool air outlet 121.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A portable air conditioner comprising:

a housing assembly having an interior space defined in the housing assembly; and an evaporating end inlet, a cool air outlet, a condensing end inlet and a hot air outlet formed through the housing assembly and communicating with the interior space;

an operating unit including a refrigerant circulating system mounted in the interior space of the housing assembly and including an evaporator, a condenser, a compressor and an expansion device that are connected with each other, wherein the evaporator is disposed beside the evaporating end inlet and the condenser is disposed beside the condensing end inlet; and an air guiding system mounted in the interior space of the housing assembly and having an air channel switching device;

an evaporating end fan mounted in the air channel switching device, and disposed adjacent to the evaporator, the evaporating end inlet and the cool air outlet; and a condensing end fan mounted in the air channel switching device, and disposed adjacent to the condenser, the condensing end inlet and the hot air outlet;

wherein a channel is formed between the evaporating end fan and the condensing end fan; and the air channel switching device selectively opens or closes the channel.

2. The portable air conditioner as claimed in claim 1, wherein the air channel switching device including:

a guiding housing, wherein the evaporating end fan and the condensing end fan are mounted in the guiding housing;

a switching valve mounted on the guiding housing;

a driving device mounted on the guiding housing and connected to the switching valve; and a guiding cover mounted on the guiding housing, wherein a upper channel is formed between the guiding cover and the guiding housing and connecting a first mounting space, in which the evaporator end fan is mounted, and a second mounted space, in which the condensing end fan is mounted;

wherein when the portable air conditioner operates in a cooling mode, the switching valve is switched to close the upper channel; and when the portable air conditioner operates in a dehumidifying mode, the switching valve is switched to open the upper channel.

3. The portable air conditioner as claimed in claim 2, wherein the guiding housing has a condensing end recess formed in one of two sides of the guiding housing, wherein the condensing end fan is mounted in the condensing end recess, the condenser is disposed by an outer side of the condensing end recess, and the condensing end inlet is disposed outside beside the condenser; and a hot air channel having two ends communicating with the condensing end recess and the hot air outlet respectively.

4. The portable air conditioner as claimed in claim 3, wherein the housing assembly has an evaporating end recess formed in the other one of the two sides of the guiding housing, wherein the evaporating end fan is mounted in the evaporating end recess, the evaporator is disposed by an outer side of the evaporating end recess, and the evaporating end inlet is disposed beside the evaporator;

a valve port formed through an upper side of the guiding housing and communicating with the evaporating end recess; and a connecting channel communicating with the evaporating end recess, the cool air outlet, and the valve port.

5. The portable air conditioner as claimed in claim 2, wherein the switching valve is a plate and has a pivot pin disposed on an end edge of the switching valve and is pivotally connected to the guiding housing beside the valve port; and a driven gear disposed on an end of the pivot pin;

the driving device has a driving gear meshing with the driven gear; and the switching valve selectively opens or closes the valve port.

6. The portable air conditioner as claimed in claim 3, wherein the switching valve is a plate and has a pivot pin disposed on an end edge of the switching valve and is pivotally connected to the guiding housing beside the valve port; and a driven gear disposed on an end of the pivot pin;

the driving device has a driving gear meshing with the driven gear; and the switching valve selectively opens or closes the valve port.

7. The portable air conditioner as claimed in claim 4, wherein the switching valve is a plate and has a pivot pin disposed on an end edge of the switching valve and is pivotally connected to the guiding housing beside the valve port; and a driven gear disposed on an end of the pivot pin;

the driving device has a driving gear meshing with the driven gear; and the switching valve selectively opens or closes the valve port.

8. The portable air conditioner as claimed in claim 5, wherein the housing assembly further has a shielding panel disposed by the cool air outlet, and the shielding panel selectively opens or covers the cool air outlet.

9. The portable air conditioner as claimed in claim 6, wherein the housing assembly further has a shielding panel disposed by the cool air outlet, and the shielding panel selectively opens or covers the cool air outlet.

10. The portable air conditioner as claimed in claim 7, wherein the housing assembly further has a shielding panel disposed by the cool air outlet, and the shielding panel selectively opens or covers the cool air outlet.

11. The portable air conditioner as claimed in claim 2, wherein two guiding rails are mounted on an end, which is disposed adjacent to the connecting channel, of the guiding housing; and the switching valve is a soft plate and has a main body;

a guiding portion formed on a side edge of a top surface of the main body and connected with the driving device; and multiple guiding elements mounted on an outer peripheral edge of the main body, and each of the guiding elements is mounted on a corresponding one of the guiding rails and being slidable relative to the corresponding one of the guiding rails.

12. The portable air conditioner as claimed in claim 3, wherein two guiding rails are mounted on an end, which is disposed adjacent to the connecting channel, of the guiding housing; and the switching valve is a soft plate and has a main body;

a guiding portion formed on a side edge of a top surface of the main body and connected with the driving device; and multiple guiding elements mounted on an outer peripheral edge of the main body, and each of the guiding elements is mounted on a corresponding one of the guiding rails and being slidable relative to the corresponding one of the guiding rails.

13. The portable air conditioner as claimed in claim 4, wherein two guiding rails are mounted on an end, which is disposed adjacent to the connecting channel, of the guiding housing; and the switching valve is a soft plate and has a main body;

a guiding portion formed on a side edge of a top surface of the main body and connected with the driving device; and multiple guiding elements mounted on an outer peripheral edge of the main body, and each of the guiding elements is mounted on a corresponding one of the guiding rails and being slidable relative to the corresponding one of the guiding rails.

14. The portable air conditioner as claimed in claim 11, wherein the guiding portion is a rack; and the driving device has a driving gear meshing with a driven gear, and the driven gear meshes with the guiding portion.

15. The portable air conditioner as claimed in claim 12, wherein the guiding portion is a rack; and the driving device has a driving gear meshing with a driven gear, and the driven gear meshes with the guiding portion.

16. The portable air conditioner as claimed in claim 13, wherein the guiding portion is a rack; and the driving device has a driving gear meshing with a driven gear, and the driven gear meshes with the guiding portion.

17. The portable air conditioner as claimed in claim 14, wherein the housing assembly further has a shielding panel disposed by the cool air outlet, and the shielding panel selectively opens or covers the cool air outlet.

18. The portable air conditioner as claimed in claim 15, wherein the housing assembly further has a shielding panel disposed by the cool air outlet, and the shielding panel selectively opens or covers the cool air outlet.

19. The portable air conditioner as claimed in claim 16, wherein the housing assembly further has a shielding panel disposed by the cool air outlet, and the shielding panel selectively opens or covers the cool air outlet.

20. An operation mode switching method of the portable air conditioner as claimed in claim 1, and the operation mode switching method having a cooling mode, wherein in the cooling mode, the air channel switching device closes the channel between the evaporating end fan and the condensing end fan; and a dehumidifying mode, wherein in the dehumidifying mode, the air channel switching device opens the channel between the evaporating end fan and the condensing end fan.

* * * * *